US005188527A

United States Patent [19]

Laiquddin et al.

[11] Patent Number: 5,188,527

[45] Date of Patent: Feb. 23, 1993

[54] METHOD OF AND SYSTEM FOR CLEANING THE SURFACE OF FURNACE ROLLERS OF A ROLLER HEARTH FURNACE

[75] Inventors: Sahibzada S. R. Laiquddin, Dorsten; Lenzel Franz J., Neuss, both of Fed. Rep. of Germany

[73] Assignee: Ruhrgas Aktiengesellschaft, Essen, Fed. Rep. of Germany

[21] Appl. No.: 457,818

[22] PCT Filed: Oct. 15, 1988

[86] PCT No.: PCT/EP88/00925

§ 371 Date: Jul. 19, 1990

§ 102(e) Date: Jul. 19, 1990

[87] PCT Pub. No.: WO89/03967

PCT Pub. Date: May 5, 1989

[30] Foreign Application Priority Data

Oct. 23, 1987 [DE] Fed. Rep. of Germany ..... 3735949

[51] Int. Cl.[5] ..... F27D 1/16

[52] U.S. Cl. ..... 432/3; 432/75; 432/246

[58] Field of Search ..... 432/3, 75, 76, 246

[56] References Cited

U.S. PATENT DOCUMENTS

| | | | |
|---|---|---|---|
| 4,249,888 | 2/1981 | Werych | 432/3 |
| 4,764,108 | 8/1988 | Carthew et al. | 432/3 |
| 5,088,921 | 2/1992 | Csehi et al. | 432/76 |

FOREIGN PATENT DOCUMENTS

| | | |
|---|---|---|
| 2242108 | 3/1974 | Fed. Rep. of Germany . |
| 1383981 | 12/1965 | France . |

*Primary Examiner*—Henry C. Yuen

*Attorney, Agent, or Firm*—Spensley Horn Jubas & Lubitz

[57] ABSTRACT

A roller hearth furnace (1) is subdivided into detachably assembled sections (2). In order to clean the rollers, one of the sections (2) of the assembly is removed and replaced by a replacement section (7) previously heated to the furnace operating temperature. The section (2) removed can therefore cool before being cleaned. The sections (2, 7) are transported along a stretch of rails (3) parallel to the roller hearth furnace (1).

10 Claims, 2 Drawing Sheets

1
2
3
4
5
6
7
8
9
III
III 1
2
3
4
7
8'
10
11
12
13

METHOD OF AND SYSTEM FOR CLEANING THE SURFACE OF FURNACE ROLLERS OF A ROLLER HEARTH FURNACE

The invention relates to a method and a device for cleaning the surface of the furnace rollers of a roller hearth furnace.

It was hitherto necessary to shut down the roller hearth furnace and to cool it down to ambient temperature when it became necessary to clean the surface of the furnace rollers. This practice caused especially in the case of long roller hearth furnaces which have a length of 100 m to 150 m, considerable shutdown times of an order of 8 to 10 days. The loss of production was correspondingly high.

It is the object of the present invention to substantially shorten the shutdown times of the roller hearth furnace necessary for cleaning the furnace rollers.

To achieve this objective, the method referred to hereinabove is characterized by the removal of at least one of a multiplicity of furnace sections detachably assembled to form the roller hearth furnace from the furnace assembly in a direction which is transverse to the direction of travel through the roller hearth furnace, the integration in the furnace assembly of a replacement furnace section preheated to operating temperature to replace the furnace section so removed and the cool-down of the furnace section so removed to a temperature allowing its furnace rollers to be cleaned and their cleaning being carried out.

The roller hearth furnace must hence be shut down only until one of its furnace sections has been replaced by a preheated replacement furnace section. It is of essential importance that no cool-down or heating-up times are required. The time of such a shutdown may be reduced to approximately 20 to 30 minutes.

The method proposed by the present invention is particularly important in the case of high-temperature methods in which the temperature is above approximately 700° C. The forward or reverse travel of plates or slabs then causes, through scale carried into or formed inside such a furnace, the build-up of lamination-type deposits on the surface of the furnace rollers commonly referred to as pickups or scale pickups. They damage the charge to be processed and must hence be removed. The build-up of pickups is a function of time. A complete cleaning operation is normally required at intervals of one to two months.

Using the method proposed by the present invention, such cleaning operations may be carried out in cycles. If a roller hearth furnace comprises, for example, twelve furnace sections of a length of 10 m each, then on average two furnace sections must be replaced and cleaned each week.

A typical application is provided by a continuous furnace for reheating thin slabs. The slabs are cast, passed through the roller hearth furnace and are thereafter rolled. Since the travel of the slabs must be accelerated inside the furnace, the alternative use of a walking-beam furnace where scale pickup problems are not encountered, is not possible. The plant operates continuously around the clock. It is only sometimes shut down when an empty ladle is replaced by a full ladle. The shutdown times take approximately 30 minutes. The method proposed by the present invention is in such cases the only method of avoiding longer shutdown times.

Preferably, the furnace section removed is preheated to operating temperature after its furnace rollers have been cleaned and is kept ready as a replacement furnace section. It is hence only necessary to have a single additional furnace section to apply the method proposed by the present invention.

It is also advantageous for the furnace section to be preheated to operating temperature to be connected with services for water, electricity, fuel, exhaust etc. and preferably with those of the roller hearth furnace. Heat-up is hence by the equipment such as burners etc. forming anyway part of the furnace section.

To minimize heat loss and to prevent a cool-down of the furnace rollers located close to the face sides, the present invention proposes that the face side of each of the two furnace sections adjacent to the furnace section removed from the furnace assembly and exposed by the removal and the face sides of the replacement furnace section to be preheated to operating temperature are kept closed until the replacement furnace section has been integrated in the furnace assembly.

The device for cleaning the surface of the furnace rollers of a roller hearth furnace proposed by the present invention is characterized in that the roller hearth furnace is subdivided into a multiplicity of detachably assembled furnace sections and at least one stretch of rails runs parallel to the roller hearth furnace, at least one car designed to accommodate at least one furnace section running thereon. This car is used to carry away the furnace section removed and to bring the replacement furnace section. It is possible to make arrangements for two stations on the car allowing both furnace sections to be accommodated simultaneously. Normally, two cars will be used.

The latter arrangement will in particular be used, if, according to one of the embodiments of the present invention, the stretch or rails extends beyond each end of the roller hearth furnace by at least the length of one furnace section and a preheating station is arranged at at least one of its two ends and preferably at both ends. Such an arrangement allows in any case an extremely rapid replacement irrespective of the location at which a furnace section is to be replaced.

Space conditions often do not allow the stretch of rails to be extended beyond the ends of the roller hearth furnace. To allow nevertheless an easy replacement of the outer furnace sections at the two ends of the roller hearth furnace, the present invention proposes that holding stations for at least two furnace sections are arranged adjacent to the stretch of rails and that a preheating station is arranged at at least one of the holding stations. This embodiment of the present invention offers the additional advantage that a single car may be used on the stretch of rails without increasing time requirements.

Preferably, each furnace section is movable on wheels at least in a direction which is transverse to the direction of travel through the roller hearth furnace.

According to another advantageous characteristic, each furnace section is provided with its own metering and control system. It may hence tie into services at all points where the latter are accessible, in particular over the entire length of the roller hearth furnace.

The present invention also provides for each furnace section to have its own roller hearth drive. It is well known that due to drive reasons the roller hearth drive of long roller hearth furnaces is sub-divided into sections, but in the present case the characteristic serves to simplify and to accelerate the disassembly and the assembly of the detachably assembled furnace sections.

The latter is also facilitated by the face sides of the furnace sections each being provided with a channel around its circumference outwardly open in the axial direction wherein a fiber module displaceable in the axial direction is arranged around the circumference. If the coupling between a furnace section and its adjacent furnace section is to be detached, the fiber modules are retracted. A gap is thereby created, as the channels are not in contact with each other. For assembly, the fiber modules are pressed against each other, thereby instantaneously sealing the roller hearth furnace.

The present invention will now be described in more detail with reference to preferred embodiments of the device referring to the accompanying drawing. In the drawing, FIG. 1 is a schematic floor plan of a first embodiment of the present invention;

Figure 1:
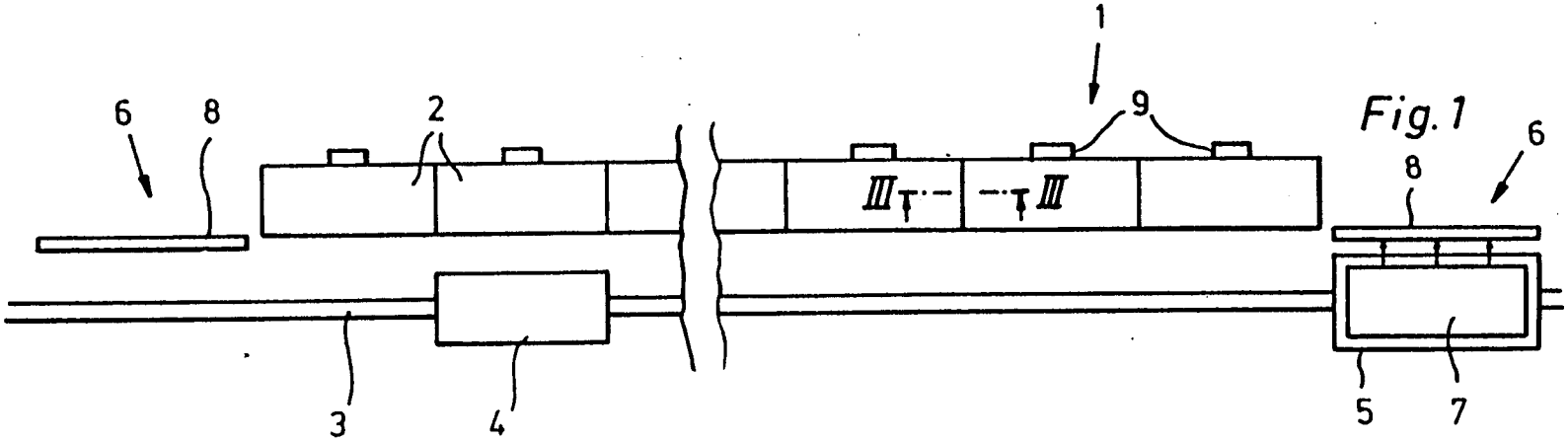

According to FIG. 1, a roller hearth furnace 1, consisting of separate furnace sections 2 is proposed. The latter are detachably assembled. A stretch of rails 3 on which two cars 4 and 5 run, runs parallel to the roller hearth furnace 1. The stretch of rails extends beyond the ends of the roller hearth furnace by more than the length of one furnace section at each of its ends. Provision is thereby made to allow the replacement of the furnace sections 2 located at the furnace end.

Car 4 is empty and ready to take the opposite furnace section. Car 5 is stationed in a preheating station 6 at the right-hand end of the stretch of rails 3. A replacement furnace section 7 located thereon is connected with utility supply and disposal services 8 for fuel, water, electricity and exhaust. The disposal services are the services of the roller hearth furnace. The replacement furnace section 7 has been preheated to operating temperature using its own burners.

A preheating station 6 with utility supply and disposal services 8 is also arranged at the left-hand end of the stretch of rails 3.

As soon as car 4 has received the opposite furnace section, car 5 takes replacement furnace section 7 to the empty space which is thereupon closed. The furnace section carried away by car 4 may cool down so that the rollers may thereupon be cleaned without problem. During the replacement, all faces of the heated furnace sections remain closed as long as possible. Covers not depicted are used therefor.

As soon as the rollers of the furnace section carried away by car 4 have been cleaned, the furnace section is taken to the left-hand side preheating station 6 and heated there to operating temperature.

Each furnace section disposes of its own metering and control system 9 to allow tie-in with utility supply and disposal services wherever the latter are available.

Figure 2:
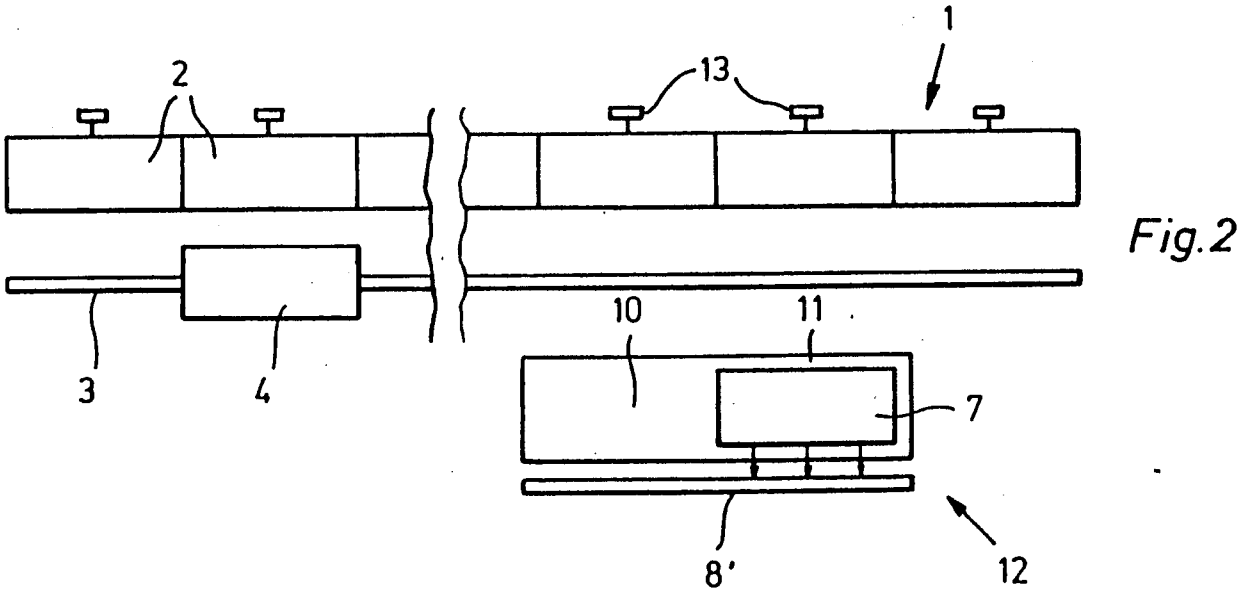
FIG. 2 is a schematic floor plan of a second embodiment of the present invention.

In the embodiment according to FIG. 2, the stretch of rails ends at both sides at the ends of roller hearth furnace 1. To make nevertheless provisions for replacement of the furnace sections 2 located at the ends, holding stations 10 and 11 for furnace sections are arranged adjacent to stretch of rails 3. Holding stations 10 and 11 are at the same time a preheating station 12 with utility supply and disposal services 8'.

As soon as car 4 has received the opposite furnace section, it takes it to holding station 10 and thereupon picks up replacement furnace section 7 from holding station 11. It takes it back to the empty space which is thereupon closed. The furnace placed at holding station 10 cools down and is thereupon cleaned.

As indicated schematically in FIG. 2, each furnace section disposes of its own roller hearth drive 13, whereby the removal of furnace sections from the furnace assembly and the re-integration are facilitated and accelerated.

Figure 3:
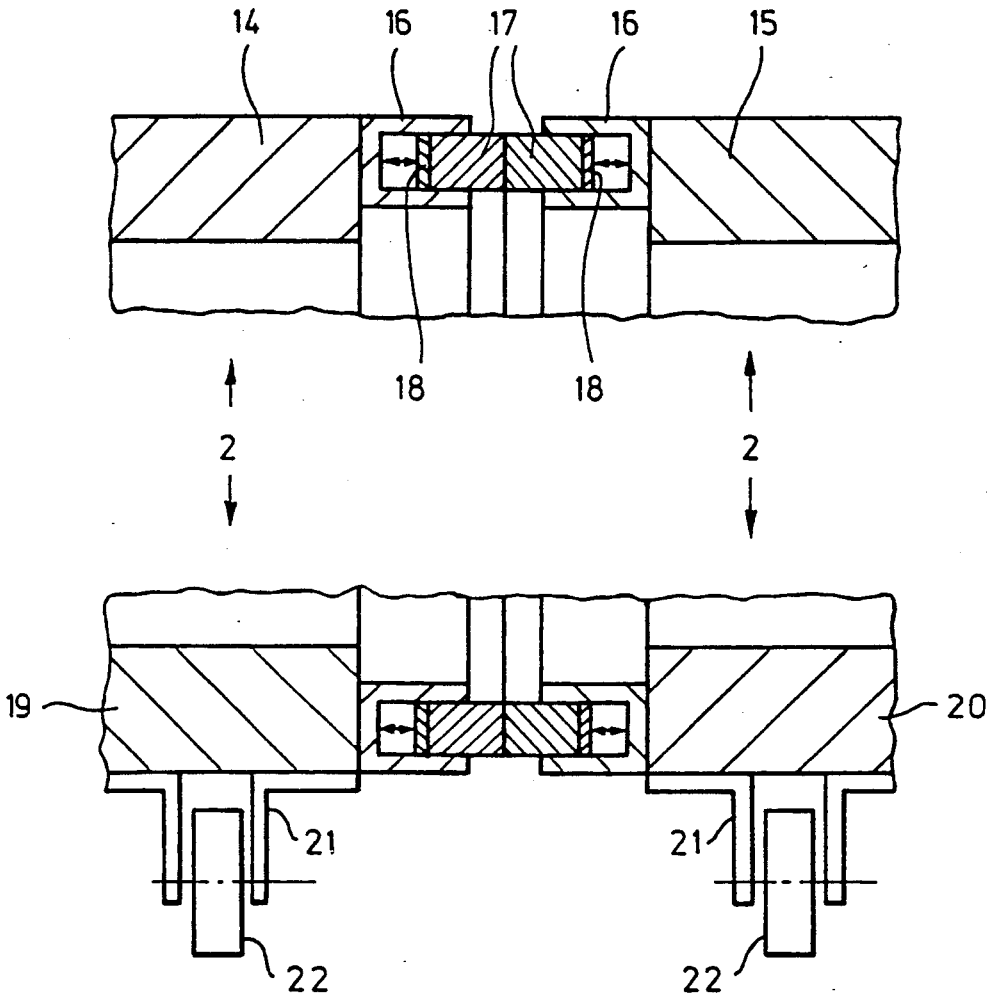
FIG. 3 is a partly broken section along line III—III in FIG. 1.

The same purpose is served by the design according to FIG. 3. The top part shows the roofs 14 and 15 of two adjacent furnace sections 2. The face sides of the furnace sections feature channels 16 around their circumferences facing each other wherein fiber modules 17 are dispaceably arranged. They are supported by metal plates 18.

FIG. 3 shows the sealed condition wherein the fiber modules 17 are pressed against each other. To remove one of the furnace sections 2, the fiber modules 17 are retracted into the channels 16. The removal may then be completed without any problem as an appropriate space is provided between the channels.

In the bottom part of FIG. 3, the floors 19 and 20 of the two furnace sections 2 are shown. The floors are provided with brackets 21 extending downward which serve to carry wheels 22, as shown schematically. On the wheels, each furnace section 2 may be moved in a direction which is transverse to the direction of travel through roller hearth furnace 1. It may be moved out of the furnace assembly onto car 4 and therefrom to one of the holding stations 10, 11, if desired.

It is also possible to vary the arrangement such that the furnace sections 2 may also be moved in the direction of travel through roller hearth furnace 1. They may then be moved from one of cars 4, 5 to the other one or from one of holding stations 10, 11 to the other one.

We claim:

1. In a roller-hearth furnace having a plurality of hearth rollers and defining a working temperature and a direction of charge travel, a method of cleaning the surface of the hearth rollers, the method comprising:

providing a plurality of detachably coupled furnace sections, each of the furnace sections having at least one hearth roller, removing at least one of the plurality of furnace sections from the plurality of detachably coupled furnace sections in a direction transverse to the direction of charge travel, preheating a spare furnace section to the furnace working temperature, integrating the spare furnace section into the plurality of detachably coupled furnace sections to thereby replace the removed furnace section, allowing the removed furnace section to cool to a temperature at which the at least one hearth roller of the removed furnace section may be cleaned, cleaning the at least one hearth roller of the removed furnace section, heating the removed furnace section to the furnace working temperature following the step of cleaning the at least one hearth roller, and maintaining the heated removed furnace section as a spare furnace section.

2. The method according to claim 1 further comprising the step of providing the spare furnace section with at least one of the services of water, electricity, fuel, and exhaust.

3. The method according to claim 1 wherein the spare furnace section defines at least one side face, wherein each of the plurality of detachably coupled furnace sections defines at least one side face, wherein the step of removing at least one of the plurality of furnace sections from the plurality of detachably coupled furnace sections exposes at least one side face of the plurality of detachably coupled furnace sections, and wherein the at least one side face of the spare furnace section and the at least one side face of the plurality of detachably coupled furnace sections are kept closed until after the step of integrating the spare furnace section into the plurality of detachably coupled furnace sections.

4. In a roller-hearth furnace having a plurality of hearth rollers and defining a working temperature and a centerline, a system for cleaning the surfaces of the hearth rollers, the system comprising:

a plurality of detachably coupled furnace sections, each of the furnace sections having at least one hearth roller, at least one rail substantially adjacent to the roller-hearth furnace and running substantially parallel to the centerline of the roller-hearth furnace, and a car configured to carry at least one furnace section on the rail.

5. The system according to claim 4 wherein the roller-hearth furnace defines two ends, the rail defines two ends, the rail extends beyond each end of the roller-hearth furnace by a distance substantially equal to the length of one of the furnace sections, and further comprising at least one preheating station arranged at an end of the rail.

6. The system according to claim 4, further comprising at least two holding stations for furnace sections arranged substantially adjacent to the rail, and at least one preheating station arranged adjacent to at least one of the holding stations.

7. The system according to claim 4, wherein the roller-hearth furnace defines a direction of charge travel, further comprising:

a plurality of wheels associated with at least one of the furnace sections for enabling the at least one furnace section to travel at least in a direction transverse to the direction of charge travel.

8. The system according to claim 4 further comprising an instrumentation and control system associated with each of the plurality of furnace sections.

9. The system according to claim 4 further comprising a roller drive assembly associated with each of the plurality of furnace sections.

10. The system according to claim 4 wherein each of the plurality of detachably coupled furnace sections defines two side faces and an axial direction, each of the two side faces having a circumference and a channel around the circumference, the channel opening in the axial direction away from at least one of the side faces, and further comprising a fiber module held in the channel around the circumference, the fiber module being displaceable in the axial direction.

* * * * *